US005161795A

United States Patent [19]

Kim et al.

[11] Patent Number: 5,161,795

[45] Date of Patent: Nov. 10, 1992

[54] DEVICE AND METHOD FOR CONTROLLING A SORTER

[75] Inventors: Jeong H. Kim, Dongjak-Ku; Young S. Park, SeongdongKu, both of Rep. of Korea

[73] Assignee: Sindo Ricoh Co., Ltd., Seoul, Rep. of Korea

[21] Appl. No.: 714,456

[22] Filed: Jun. 13, 1991

[30] Foreign Application Priority Data

Mar. 12, 1991 [KR] Rep. of Korea ..... 1991-3952

[51] Int. Cl.[5] ..... B65H 39/10

[52] U.S. Cl. ..... 271/288; 271/294; 271/298; 355/323; 364/478; 209/546; 209/534; 270/53

[58] Field of Search ..... 271/287, 288, 292, 293, 271/294, 298; 355/321, 323; 364/478; 209/546, 534, 900; 270/53

[56] References Cited

U.S. PATENT DOCUMENTS

| | | | |
|---|---|---|---|
| 4,512,565 | 4/1985 | Matsumoto et al. | 271/288 X |
| 4,738,443 | 4/1988 | Honjo et al. | 271/288 |
| 5,013,027 | 5/1991 | Furukawa | 271/298 X |
| 5,048,820 | 9/1991 | Chung et al. | 271/294 X |

*Primary Examiner*—H. Grant Skaggs
*Assistant Examiner*—Carol Lynn Druzbick
*Attorney, Agent, or Firm*—Darby & Darby

[57] ABSTRACT

A device and a method for controlling a sorter. The device comprises a central control unit, an interface unit connected between a control unit of the copy machine and the central control unit, an one third rotation sensor for controlling operation of transfer wheels, a home position sensor for sensing home positions of bin trays and outputting a sensed signal to the central control unit, and a bin motor driving circuit adapted for controlling normal and reversed rotations of a bin motor. The method comprises the steps of initializing by setting up bin tray numbers, uniformly arranging the bin trays at a home position, setting up a mode state of the sorter into a non-sort mode, sensing a signal representing whether a copy sheet is ejected and a signal representing whether a mode state is changed, transferring the uppermost bin tray to a waiting position and receiving the copy sheets upon sensing a signal representing that the copy sheets are ejected, transferring upwards the uppermost bin tray to the waiting position and successively transferring upwards or downwards the bin trays in response to the copy sheet ejecting signal, transferring upwards the uppermost bin tray to the waiting position and receiving the copy sheets of a document, then transferring upwards another bin trays one by one in order to receive new copy sheets, and repeating the procedure upon sensing a signal representing that the mode state is changed into a non-sort mode.

8 Claims, 10 Drawing Sheets

Group
528
Top Bin ?
Yes
No
529
Home?
Yes
No
530
Home
531
Bin Up
Loop3
Mode←Group
532
533
Ejecting ?
No
Yes
534
Sort?
No
Yes
535
Group?
No
Yes
536
Non-Sort ?
No
Yes
538
Jam
Yes
537
Jam?
No
Sort
Group
Non-Sort
Loop3
539
Last Sheet ?
540
Bin Move ?
No
Yes
541
Bin Up
Loop3

DEVICE AND METHOD FOR CONTROLLING A SORTER

BACKGROUND OF THE INVENTION

1. Field of the Invention

The present invention relates to a sorter for copy machine, and more particularly to device and method for controlling the sorter, said sorter having slot liners each having an inclined middle portion extending to the ejecting section of the copy machine, and transfer wheels each provided with three slots each radially formed at 120° angle centering around the center of said transfer wheel and three pairs of insert wheels, each pair of said insert wheels mounted between two slots.

2. Description of the Prior Art

Generally, a known sorter for copy machine, which is equipped with slot liners and transfer wheels, has adopted a method of arranging and separating the copy sheets by transferring successively each pair of pin trays of a plurality of bin trays.

However, there has been a gap between the ejecting section of the copy machine and the bin tray of the known sorter so that the sorter might require an auxiliary unit for stable receiving the copy sheets, thereby causing a device for controlling the known sorter to be complicated.

Referring now to FIG. 1 which is a schematic block diagram for representing a control device for controlling a known sorter, the control device of the known sorter is provided with a central control unit 11 for controlling the operation of the sorter, said central control unit 11 generally comprising an one chip microprocessor having ROM and RAM therein or a separable processor and memory. Also, there is provided an interface unit 12 connected between a control unit of the copy machine and the central control unit 11 and adapted for receiving a control signal from one side and sending the signal to the other side. In addition, the control device is provided with a copy sheet ejecting sensor 13, an one half rotation sensor 14, a home position sensor 15, a feed motor driving circuit 16 and a bin motor driving circuit 18, said copy sheet ejecting sensor 13 adapted for sensing the ejecting of the copy sheet from the copy machine and outputting a sensed signal to the central control unit 11, said one half rotation sensor 14 for controlling an operation of the transfer wheels each having two slots, said home position sensor 15 for sensing home positions of the bin trays and outputting the sensed signal to said central control unit 11, said feed motor driving circuit 16 for driving a feed motor 17 which is adapted for feeding the copy sheets under the control of the central controlling unit 11, and capable of rotating in normal direction, said bin motor driving circuit 18 connected to the central controlling unit 11 and adapted for driving a bin motor 19 which is adapted for driving the transfer wheels for transferring the bin trays upwards and downwards, and capable of rotating in normal and reversed directions.

However, in the known sorter having the above-mentioned control device, it has been noted that there were several disadvantages of complicate structure, slow processing speed of the control device and slow separating speed of the copy sheets.

SUMMARY OF THE INVENTION

It is, therefore, an object of the present invention to provide a device and a method for controlling a sorter which have a relatively simple structure, which can locate the bin trays accurately and separate the copy sheets at high speed, thereby solving the above-mentioned disadvantages encountered in the prior art.

In an aspect, the present invention can provide in a sorter comprising slot liners each provided with an inclined middle portion extending toward ejecting section of copy machine, transfer wheels provided with three slots, a bin motor for driving said transfer wheels in order to transfer bin trays, a device for controlling said sorter, said device for controlling the sorter comprising: a central control unit for controlling operations of said sorter; an interface unit connected between a control unit of the copy machine and said central control unit and adapted for receiving a control signal from one side and sending said received signal to the other side; an one third rotation sensor for controlling operation of said transfer wheels each provided with three slots; a home position sensor for sensing home positions of said bin trays and outputting a sensed signal to said central control unit; and a bin motor driving circuit adapted for controlling normal and reversed rotations of said bin motor under control of said central controlling unit.

In other aspect, the present invention can provide in a sorter comprising slot liners each provided with an inclined middle portion extending toward ejecting section of copy machine, transfer wheels provided with three slots, a bin motor for driving said transfer wheels in order to transfer bin trays, a device for controlling said sorter, said device for controlling the sorter comprising a central control unit for controlling operations of said sorter, an interface unit connected between a control unit of the copy machine and said central control unit and adapted for receiving a control signal from one side and sending said received signal to the other side, an one third rotation sensor for controlling operation of said transfer wheels each provided with three slots, a home position sensor for sensing home positions of said bin trays and outputting a sensed signal to said central control unit, and a bin motor driving circuit adapted for controlling normal and reversed rotations of said bin motor under control of said central controlling unit, a method controlling for said sorter by using said device for controlling the sorter, said method comprising the steps of: (a) initializing by setting up bin tray numbers by means of said central control unit; (b) uniformly arranging said bin trays at a home position; (c) setting up a mode state of said sorter into a non-sort mode; (d) sensing a signal representing whether a copy sheet is ejected and a signal representing whether a mode state is changed; (e) transferring the uppermost bin tray to a waiting position and receiving said copy sheets to the last sheet upon sensing a signal representing that said copy sheets are ejected from the copy machine at said fourth step; (f) transferring upwards the uppermost bin tray to said waiting position and successively transferring upwards or downwards said bin trays in response to the copy sheet ejecting signal in order to separate said copy sheets in page order upon sensing a signal representing that said mode state of the sorter is changed into a sort mode at said (d) step; (g) transferring upwards the uppermost bin tray to the waiting position and receiving said copy sheets of a document of a page to the last sheet in response to the copy sheet ejecting signal, then transferring upwards another bin trays one by one in order to receive new copy sheets in separate pages upon sensing a signal representing that the mode state is changed into a group mode at said (e) step; and (h) repeating the procedure from said (c) step to said (g) step upon sensing a signal representing that the mode state is changed into a non-sort mode at said (d) step.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 2:
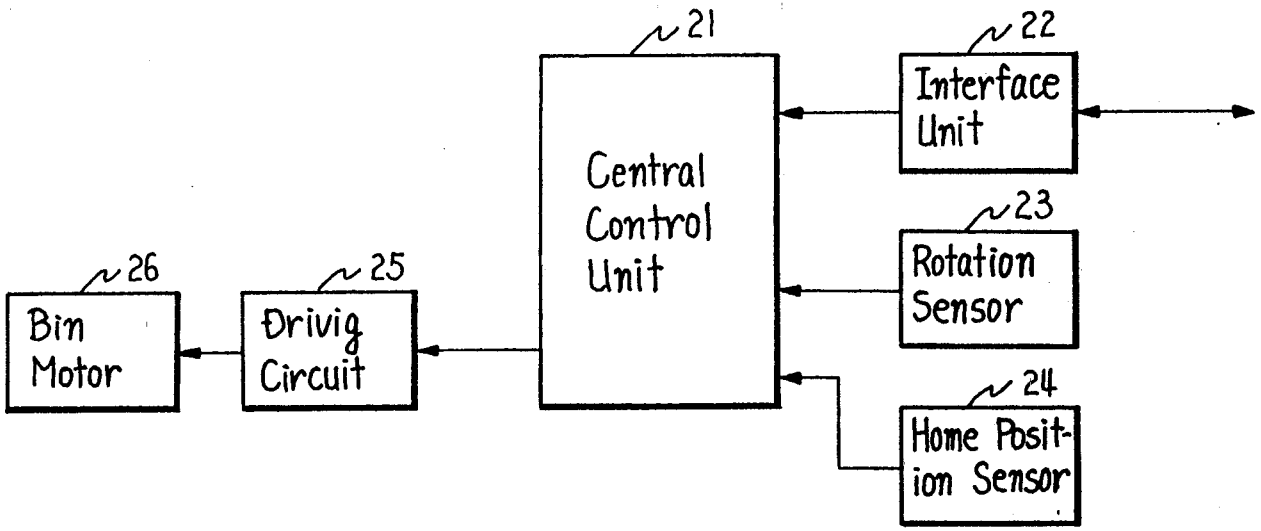
FIG. 2 is a schematic block diagram for representing a device and a method for controlling a sorter in accordance with the present invention.

Referring now to FIG. 2 which is a schematic block diagram for representing a device and a method for controlling a sorter in accordance with the present invention, the device for controlling the sorter comprising a central control unit 21, an interface unit 22, an one third rotation sensor 23, a home position sensor 24, a bin motor driving circuit 25 and a bin motor 26.

The central control unit 21 is provided in order to control the operations of the sorter and comprises an one chip microprocessor having ROM and RAM therein or separable processor and memory.

Also, the interface unit 22 is connected between a control unit of the copy machine and the central control unit 21 and adapted for receiving a control signal from one side and sending said control signal to the other side. In this embodiment, the interface unit 22 comprises a conventional interface unit.

The one third rotation sensor 23 is provided in order to sense rotation of transfer wheels each having two slots and send the sensed signal to the central control unit 21 so that the central control unit 21 can control the rotational position of the transfer wheels accurately. In this embodiment, the one third rotation sensor 23 comprises a conventional microswitch or an optical switch.

The home position sensor 24 senses a home position of the bin trays and outputs a sensed signal to the central control unit 21.

The bin motor driving circuit 25 is adapted for controlling normal and reversed rotations of the bin motor 26 under control of said central controlling unit 21 so that the bin motor 26 can rotate in normal or reversed direction in order to drive a driving section including the transfer wheels, thereby causing the bin trays to be transferred upwards or downwards.

Figure 1:
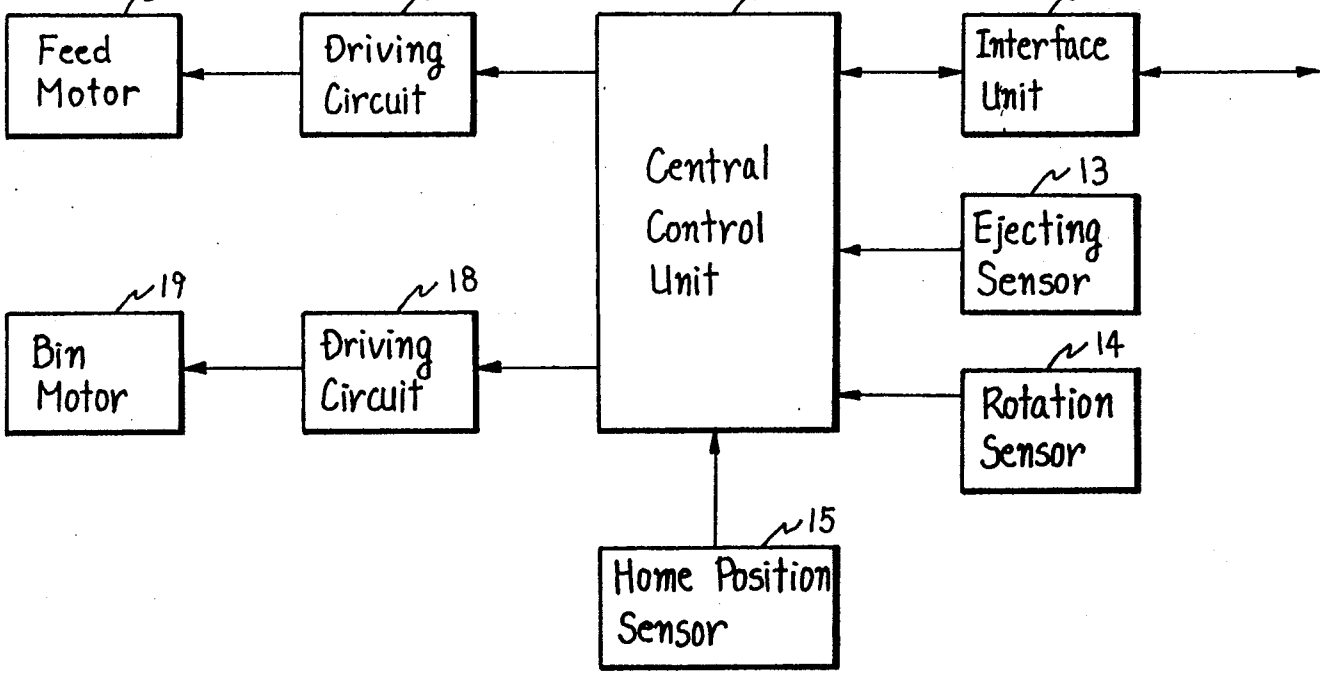
FIG. 1 ( Prior Art )
FIG. 1 is a schematic block diagram for representing a device and a method for controlling a known sorter in accordance with the prior art.

As shown in FIG. 2, the device in accordance with the present invention is so constructed that the central control unit 21 can directly receive a signal representing whether the copy sheet is ejected or not from the control unit of the copy machine, thereby causing the copy sheet ejecting sensor (see FIG. 1, reference numeral 13) to be removed. Furthermore, the sorter has slot liners each having an inclined middle portion extending toward the ejecting section of the copy machine, thus the bin trays can advance toward the ejecting section so that the copy sheets can be directly received by the bin trays without addition of an auxiliary copy sheet feeding unit, thereby causing the feed motor driving unit and the feed motor (see FIG. 1, reference numerals 16 and 17) to be removed. Hence, the device for controlling the sorter an comprise a compact circuit and provide an efficient separation and ejection of the copy sheets for the sorter.

Figure 3:
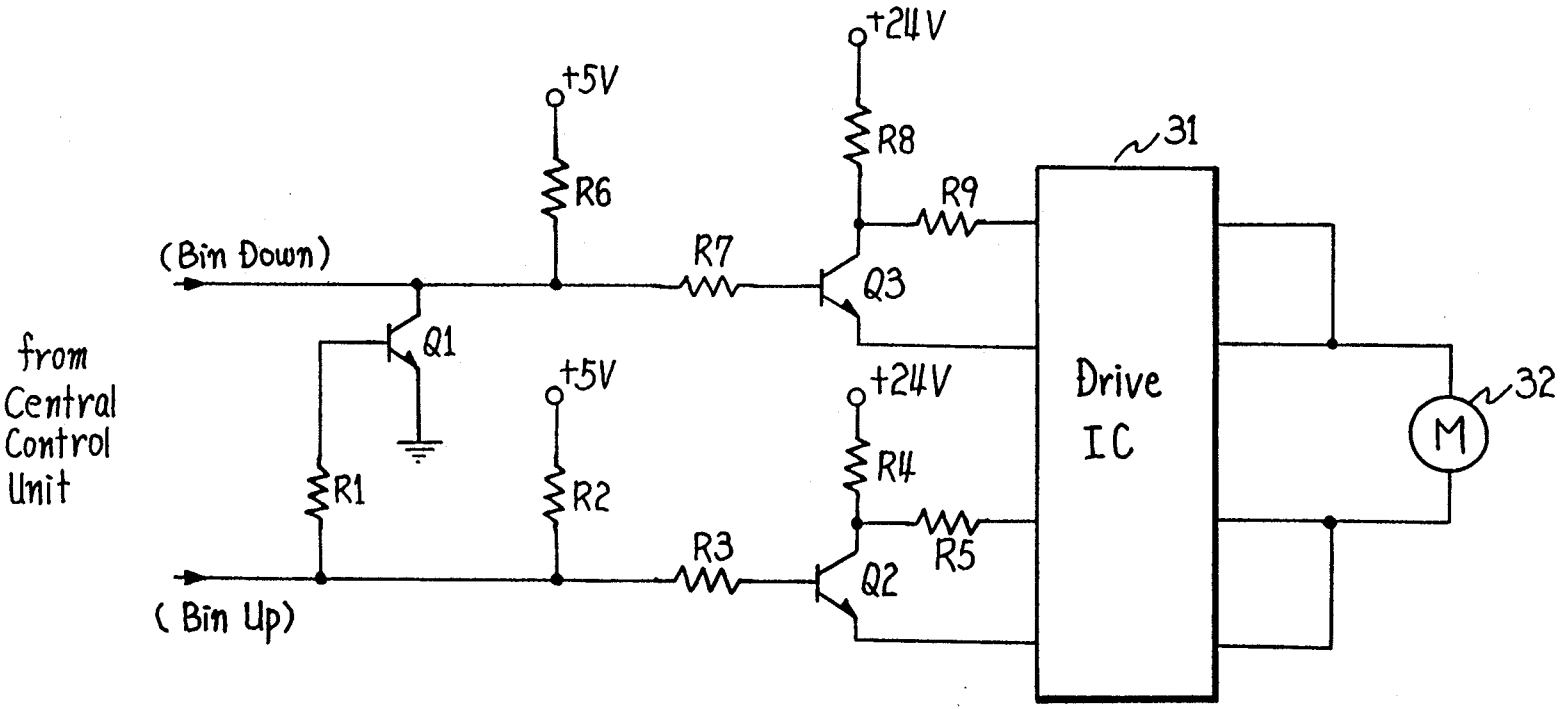
FIG. 3 is a detailed circuit diagram for an embodiment of a motor driving circuit of a control device in accordance with the present invention.

FIG. 3 is a detailed circuit diagram for an embodiment of a motor driving circuit of the control device in accordance with the present invention.

Generally, a known motor driving circuit comprises two switching transistors Q2 and Q3 which are disposed at a bin down signal output stage and a bin up signal output stage of the central control unit, respectively, so that a transistor corresponding to an output signal can be turned on in order to drive a drive integrated circuit (IC) 31. However, there has been a problem that the bin up and bin down signals might be instantaneously applied to the drive IC 31 at the same time so that the drive IC 31 might be broken or dropped its durability.

Therefore, the motor driving circuit in accordance with the present invention is, as shown in FIG. 3, additionally provided with an auxiliary switching transistor Q1 disposed as connected between two signal output stages of the central control unit 21 so that any one signal can be disregarded when the bin up and bin down signals are instantaneously applied to the central control unit 21, thereby protecting the central control unit 21 from being damaged. In this embodiment, the motor driving circuit has a NPN transistor Q1 of which the base is connected to the bin up signal output stage of the central control unit 21, and a collector is connected to the bin down signal output stage of the central control unit 21, and also the emitter is grounded so that, even though the two signals (the bin down and bin up signals) are applied to the transistor Q1 at the same time, the transistor Q1 can disregard the bin down signal, but the bin up signal can turn on the switching transistor Q2 in order to drive the drive IC 31.

Figure 4:
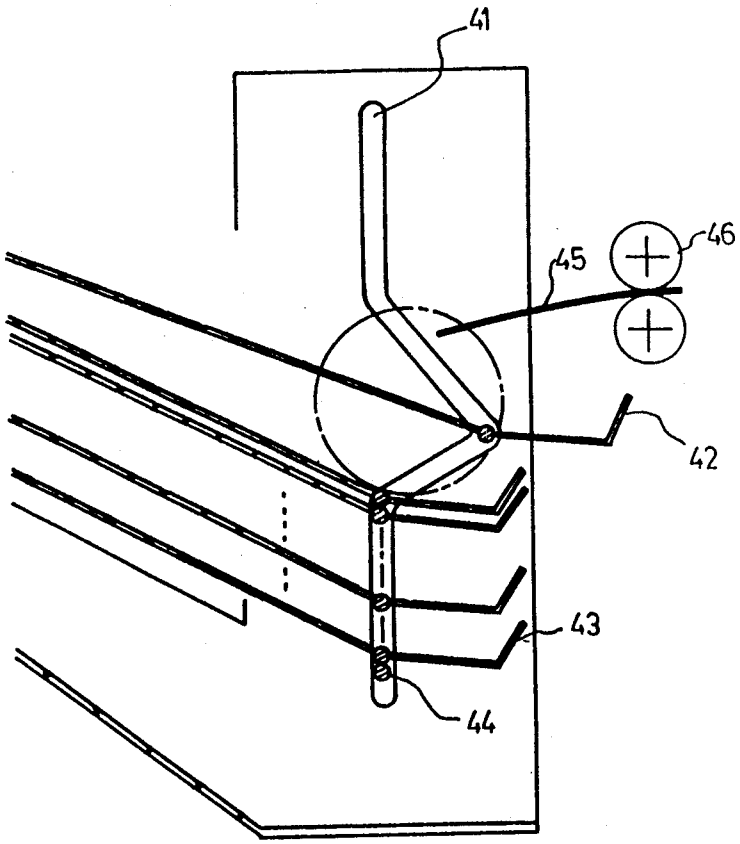
FIGS. 4A and 4B are schematic and enlarged side views showing bin tray transferring states in accordance with the present invention.
Figure 4:
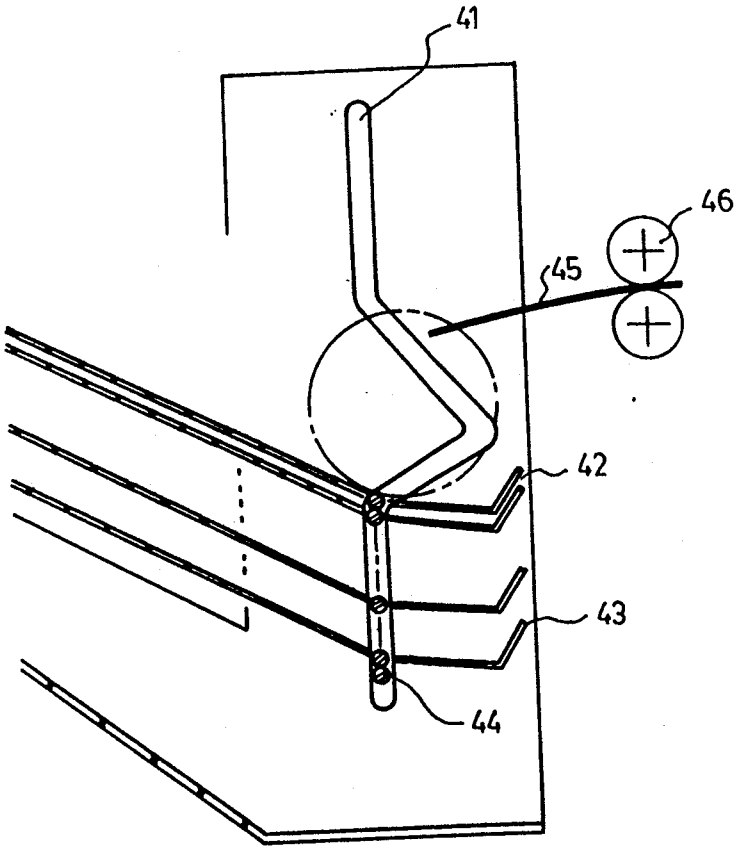

FIGS. 4 are schematic and enlarged side views showing bin tray transferring states in accordance with the present invention, in which FIG. 4A shows a state that all of the bin trays are located at home position and FIG. 4B shows a state that the uppermost bin tray 42 is located at its waiting position wherein the bin tray can receive copy sheets 45 from the ejecting rollers 46 of the ejecting section of the copy machine.

In the drawings, the reference numerals 41, 43 and 44 designate a slot liner, the lower most bin tray and a base pin of a bin tray supporter, respectively.

The method for controlling the sorter by using the above-mentioned control device in accordance with the present invention will be described in conjunction with the drawings, FIGS. 5A to 5C of flow charts showing the method controlling the sorter, FIG. 6 of a flow chart showing a home subroutine, FIG. 7 of a flow chart showing a bin up subroutine, and FIG. 8 of a flow chart showing a bin down subroutine.

Figure 5A:
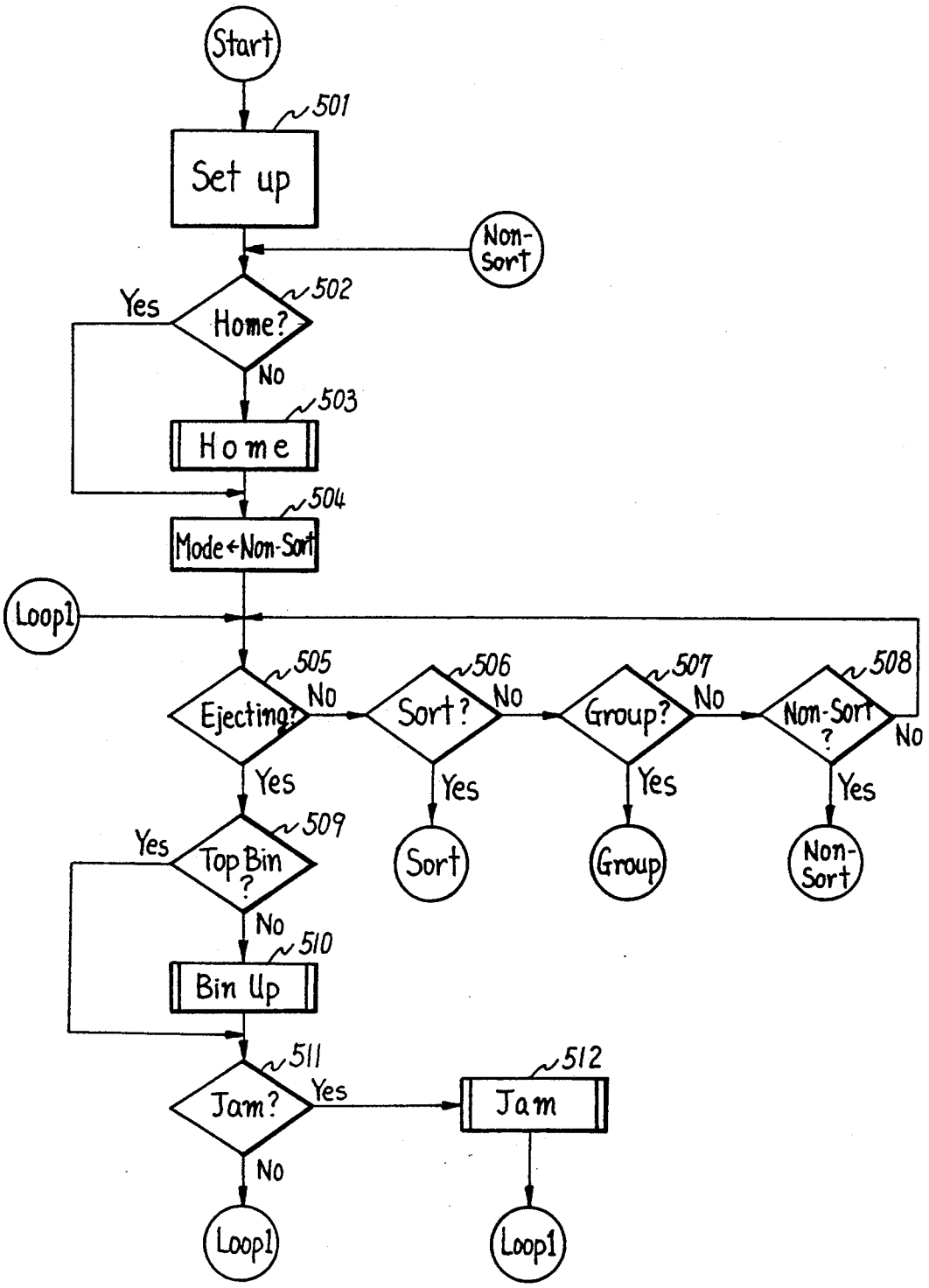
FIGS. 5A to 5C are flow charts showing the method controlling the sorter in accordance with the present invention.
Figure 5B:
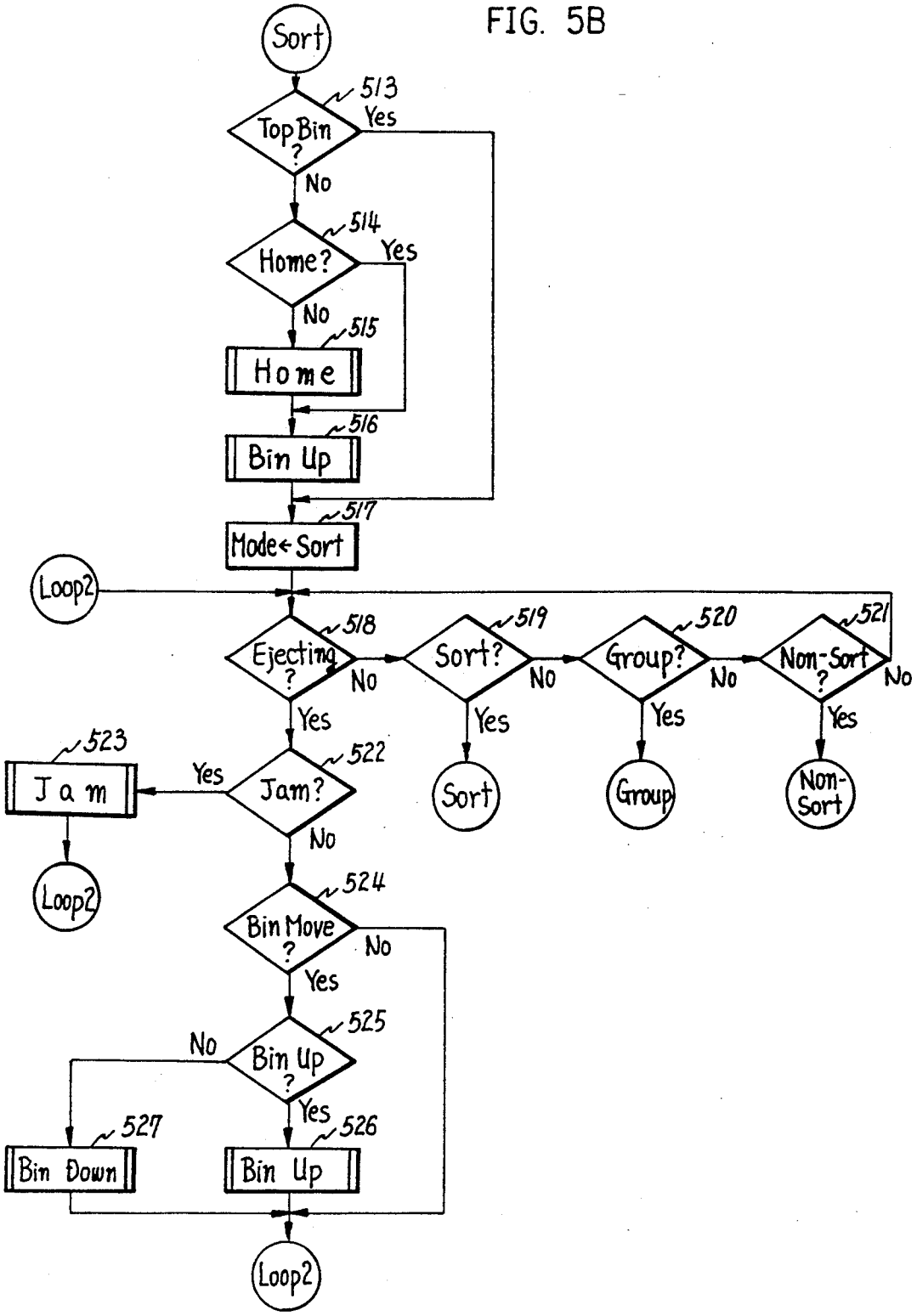
Figure 5C:
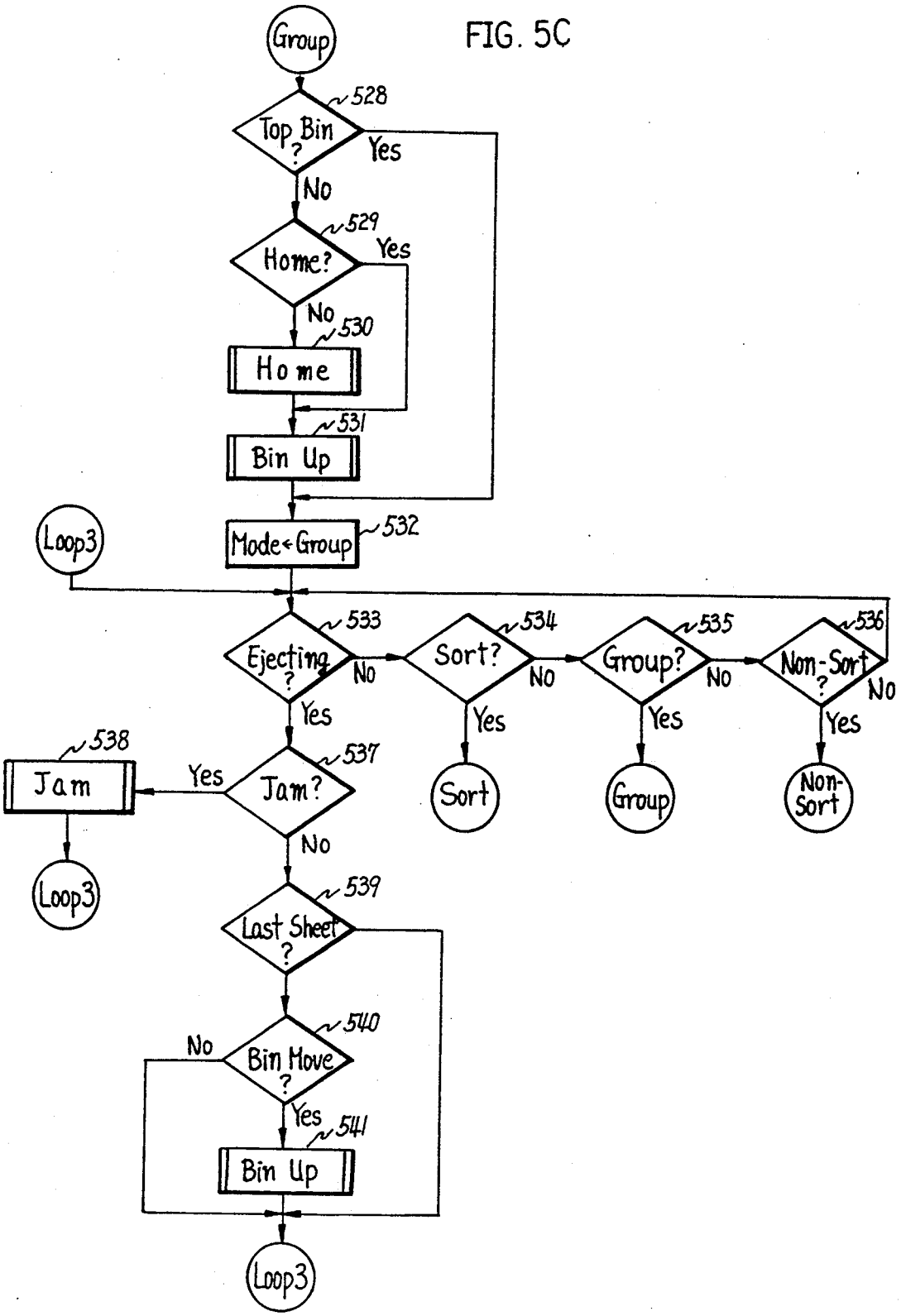

Referring to FIGS. 5A to 5B, the bin tray numbers are first set up and the sensors are checked at a step 501, and thereafter, it is determined whether the subject bin trays are located at home position at a step 502. If the answer is no, the operation proceeds to a home subroutine 503 shown in FIG. 6 in which the sorter is controlled so that the bin trays may be uniformly arranged at the home position, and thereafter, a mode state will be set up as a non-sort state at a step 504. Thereafter, a signal for the ejection of the copy sheets and signals for the mode change are sensed at steps 505 to 508. If a signal representing that the copy sheet is ejected from the copy machine is detected at the step 505, it is determined whether the uppermost bin tray is located at the waiting position at step 509. If the uppermost bin tray is not located at the waiting position, the operation proceeds to a bin up subroutine 510 shown in FIG. 7 in which the sorter is controlled so that the uppermost bin tray can be located at the waiting position in order to receive the ejected copy sheets. However, if the copy sheets are not ejected for a predetermined time after the last ejection of the copy sheet, the sorter is controlled so that the bin tray can return to the home position in order to be uniformly arranged. Also, it is determined whether there is a jamming accident in the copy machine at a step 511. If the answer is yes, the sorter is stopped operating and a jam signal is applied to the copy machine so that the jamming can be removed at a step 512, and thereafter, the operation returns to the step 505 in order to repeat the above-mentioned procedure. If a sort mode (for separating the copy sheets in page order) setting signal is inputted at a step 506, it is determined whether the uppermost bin tray is located at the waiting position at a step 513. If the uppermost bin tray is not located at the waiting position, it is determined whether the uppermost bin tray is located at the home position at a step 514. If the answer is yes, the operation simply proceeds to the bin up subroutine 516. If the answer is no, the operation moves to the bin up subroutine 516 by way of the home subroutine 515. Thereafter, the mode state is set up as a sort mode at a step 517, then it is determined whether the jamming is happened at a step 522 upon receiving a signal representing the ejection of the copy sheet at an inquiry step 518. If the answer is yes, the sorter is stopped operating, and a jam signal is applied to the copy machine so that the jamming can be removed at a step 523. However, if the answer is not, the operation proceeds through steps 524 to 527 wherein the sorter is controlled so that the bin trays may be successively transferred upwards in order to receive the ejected copy sheets.

Here, if the uppermost bin tray is not located at the waiting position, the operation proceeds through steps 519 to 521 wherein it is determined whether the sort signal is outputted, whether the group mode setting signal is outputted and whether the non-sort signal is outputted, respectively. At this time, if the copy sheets are not ejected for a predetermined time after the last ejection of the copy sheet, the sorter is controlled so that the bin tray can return to the home position in order to be uniformly arranged. However, if the uppermost bin tray is located at the waiting position, the sorter is controlled so that the bin tray may not move irrespective of receiving the sort signal and the group mode setting signal except the non-sort signal, thereby causing the durability of the sorter to be ameliorated and the required time for mode change to be reduced.

Also, if the group mode setting signal is inputted at the steps 507 and 520, the sorter is controlled so that the uppermost bin tray is transferred to the waiting position at steps 528 to 532, thereby making the whole bin trays be successively transferred upwards (BIN UP) in order to receive the copy sheets. If the signal representing the ejection of the copy sheet is detected at a step 533, the sorter can be controlled so that the bin tray can receive the copy sheets of a document of a page to the last sheet so far as there is no jamming at steps 537 and 538 in the copy machine. Thereafter, the sorter is controlled in response to a bin driving signal so that another bin tray is transferred upward at steps 540 and 541 in order to receive copy sheets of the next page, thereby causing the copy sheets ejected from the ejecting section of the copy machine to be separated in pages. In addition, if the uppermost bin tray is not located at the waiting position, the sort signal, the group mode setting signal or the non-sort signal is inputted at steps 506 to 508, or the sorter is controlled so that the bin tray can return to the home position in order to be uniformly arranged when the copy sheets are not ejected for a predetermined time after the last ejection of the copy sheet.

However, if the uppermost bin tray is located at the waiting position, the sorter is controlled so that the bin tray may not move irrespective of receiving the sort signal and the group mode setting signal except the non-sort signal, thereby causing the durability of the sorter to be ameliorated and the required time for mode change to be reduced.

Figure 6:
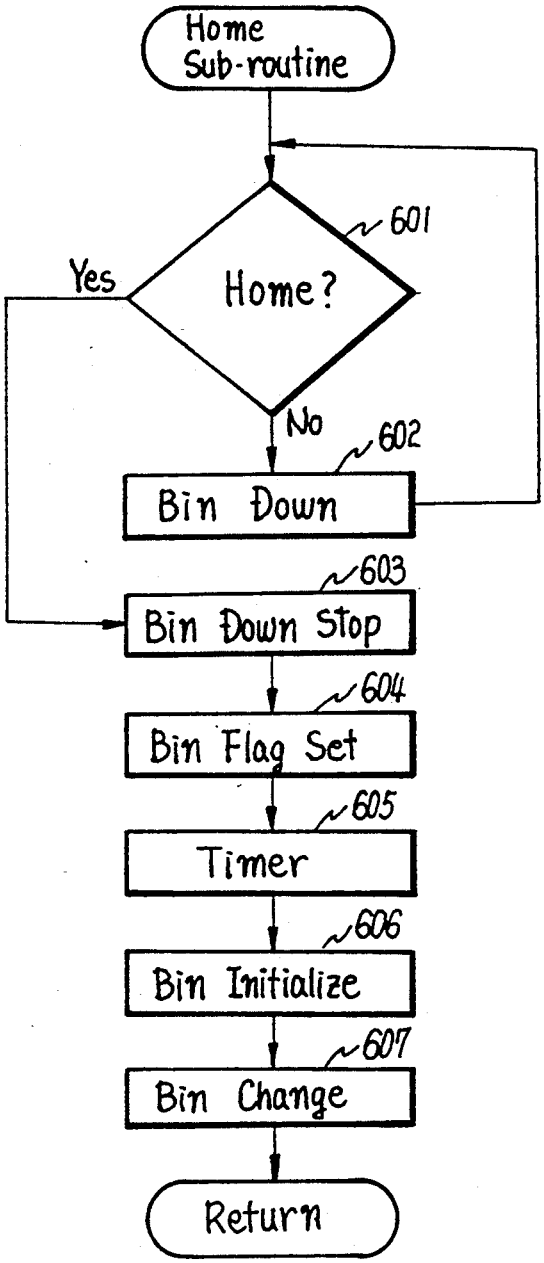
FIG. 6 is a flow chart showing a home subroutine in accordance with the present invention.

Turning next to FIG. 6 which is a flow chart showing a home subroutine in accordance with the present invention, it is first determined whether the bin tray is located at the home position at a step 601. Thereafter, the sorter is controlled so that the bin tray can be transferred downwards to the home position at a step 602 and be stopped at a step 603, and thereafter, the operation successively proceeds through a step 604 wherein the subject bin tray transferring flag is set, steps 605 and 606 wherein the timer and the bin tray numbers are initialized and a step 607 wherein the transferring direction of the bin tray is changed. Then, the operation returns to the main routine.

Figure 7:
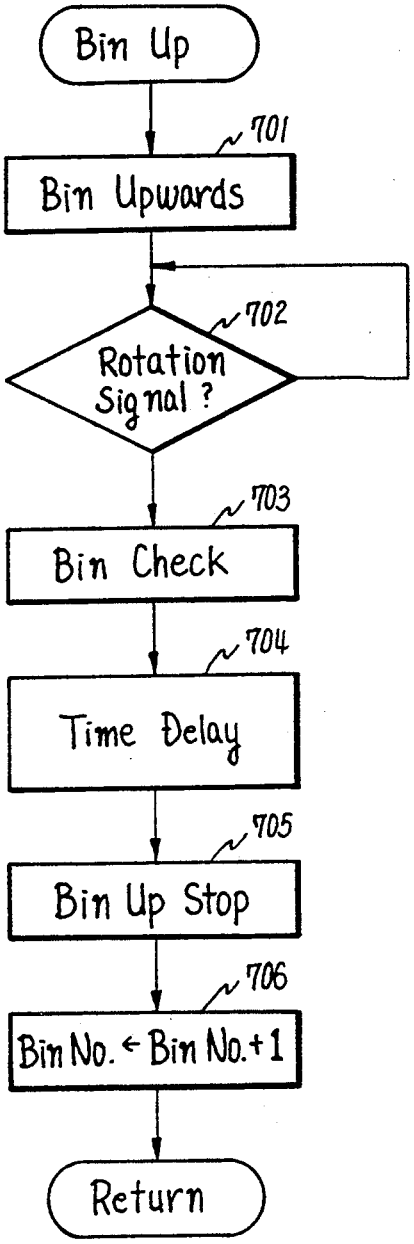
FIG. 7 is a flow chart showing a bin up subroutine in accordance with the present invention.

Referring to FIG. 7 which is a flow chart showing a bin up subroutine in accordance with the present invention, the bin tray is first transferred upwards at a step 701, and thereafter, it is determined whether the rotation signal is inputted at a step 702. If the answer is yes, the operation successively proceeds through a step 703 wherein the subject bin tray number to be transferred is checked, a step 704 which delays the time corresponding to said bin tray number, a step 705 which make the bin tray be stopped transferring and a step 706 in which the bin tray number is incremented by one so that the next bin tray may be set. Thereafter, the operation returns to the main routine.

Here, if the set mode is the non-sort mode at the delay step 704, all of the bin trays each is allotted with a predetermined delay time. However, if the set mode is other modes at the delay step 704, several predetermined delay time different from one another are allotted to the bin trays, respectively, so that a relatively lower bin tray may be allotted with a relatively longer delay time.

Figure 8:
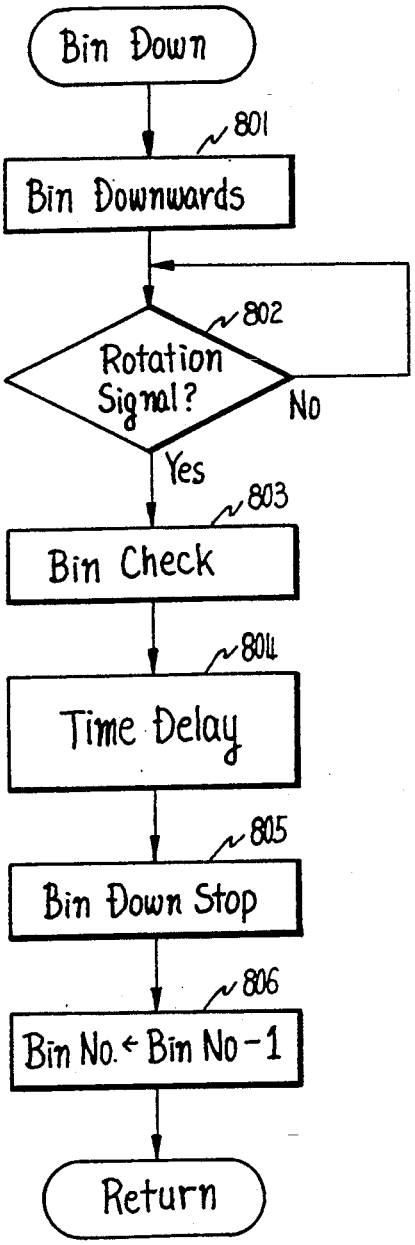
FIG. 8 is a flow chart showing a bin down subroutine in accordance with the present invention.

Turning next to FIG. 8 which is a flow chart showing a bin down subroutine in accordance with the present invention, the bin tray is first transferred downwards at a step 801, and thereafter, it is determined whether the rotation signal is inputted at a step 802. If the answer is yes, the operation successively proceeds through a step 803 wherein the subject number of the bin tray to be transferred is checked, a step 804 which delays the time corresponding to said bin tray number, a step 805 which make the bin tray be stopped downward transferring and a step 806 in which the bin tray number is incremented by one so that the next bin tray may be set. Thereafter, the operation returns to the main routine.

Here, the reason why the several predetermined delay time different from one another are allotted to the bin trays, respectively, so that the relatively lower bin tray may have the relatively longer delay time is that the transferring time of the bin trays are different from one another as a result of the successively increased loads of the bin trays. That is to say, the upper bin trays have relatively shorter transferring time than that of the lower bin trays. Thus, upon receiving the rotation signal, the subject bin tray to be transferred is checked and compensated its transferring time by being allotted with its delay time different from the others. Hence, all of the bin trays are controlled to stop at a predetermined stop position.

As above-mentioned, the present invention can provide in a device a method for controlling the sorter provided with slot liners each having an inclined middle portion extending to the ejecting section of the copy machine, and transfer wheels each provided with three slots each radially formed at 120° angle centering around the center of said transfer wheel, said device and method having a compact control circuit and providing an inexpensive manufacturing cost and an increased separating speed of the copy sheets for the sorter. Furthermore, the device and method for controlling the sorter can provide advantages of an appropriate operation in response to respective mode states and the accurate location of the bin tray at the desired position for the sorter.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. In a sorter comprising slot liners each provided with an inclined middle portion extending toward ejecting section of copy machine, transfer wheels provided with three slots, a bin motor for driving said transfer wheels in order to transfer bin trays, a device for controlling said sorter, said device for controlling the sorter comprising:

a central control unit for controlling operations of said sorter;

an interface unit connected between a control unit of the copy machine and said central control unit and adapted for receiving a control signal from one side and sending said received signal to the other side;

an one third rotation sensor for controlling operation of said transfer wheels each provided with three slots, a home position sensor for sensing home positions of said bin trays and outputting a sensed signal to said central control unit; and a bin motor driving circuit adapted for controlling normal and reversed rotations of said bin motor under control of said central controlling unit;

said bin motor driving circuit comprising:

a first switching transistor disposed at a bin down signal output stage of said central control unit;

a second switching transistor disposed at a bin up signal output stage of said central control unit;

a drive IC disposed at respective output stages of said first and second switching transistors; and a third switching transistor disposed as connected between said bin down and bin up signal output stages of said central control unit and adapted for disregarding any one signal when a bin up signal and a bin down signal are instantaneously applied to said central control unit at the same time.

2. In a sorter comprising slot liners each provided with an inclined middle portion extending toward ejecting section of copy machine, transfer wheels provided with three slots, a bin motor for driving said transfer wheels in order to transfer bin trays, a device for controlling said sorter, said device for controlling the sorter comprising a central control unit for controlling operations of said sorter, an interface unit connected between a control unit of the copy machine and said central control unit and adapted for receiving a control signal from one side and sending said received signal to the other side, an one third rotation sensor for controlling operation of said transfer wheels each provided with three slots, a home position sensor for sensing home positions of said bin trays and outputting a sensed signal to said central control unit, and a bin motor driving circuit adapted for controlling normal and reversed rotations of said bin motor under control of said central controlling unit, a method controlling for said sorter by using said device for controlling the sorter, said method comprising the steps of:

(a) initializing by setting up bin tray numbers by means of said central control unit;

(b) uniformly arranging said bin trays at a home position;

(c) setting up a mode state of said sorter into a non-sort mode;

(d) sensing a signal representing whether a copy sheet is ejected and a signal representing whether a mode state is changed;

(e) transferring the uppermost bin tray to a waiting position and receiving said copy sheets to the last sheet upon sensing a signal representing that said copy sheets are ejected from the copy machine at said (d) step;

(f) transferring upwards the uppermost bin tray to said waiting position and successively transferring upwards or downwards said bin trays in response to the copy sheet ejecting signal in order to separate said copy sheets in page order upon sensing a signal representing that said mode state of the sorter is changed into a sort mode at said (d) step;

(g) transferring upwards the uppermost bin tray to the waiting position and receiving said copy sheets of a document of a page to the last sheet in response to the copy sheet ejecting signal, then transferring upwards another bin trays one by one in order to receive new copy sheets in separate pages upon sensing a signal representing that the mode state is changed into a group mode at said (e) step; and (h) repeating the procedure from said (c) step to said (g) step upon sensing a signal representing that the mode state is changed into a non-sort mode at said (d) step.

3. A method for controlling a sorter as claimed in claim 2, wherein said step (e) comprises the steps of:

(e-1) determining whether said uppermost bin tray is located at said waiting position; and (e-2) performing a bin up subroutine corresponding to an answer of said (e-1) step.

4. A method for controlling a sorter as claimed in claim 3, wherein said step (e) further comprises the step of:

(e-3) determining whether there is a jamming in said copy machine, and upon yes answering, returning said bin tray to said home position, then applying a jam signal to said copy machine, and stopping said sorter in order to wait until said jamming is removed.

5. A method for controlling a sorter as claimed in claim 2, wherein said step (f) comprises the steps of:

(f-1) determining whether said uppermost bin tray is located at said waiting position;

(f-2) upon no answering, determining whether said uppermost bin tray is located at said home position;

(f-3) If said uppermost bin tray is not located at said home position, performing a home subroutine, then said bin up subroutine;

(f-4) setting up said mode state of said sorter into a sort mode;

(f-5) sensing a signal representing whether said copy sheets are ejected and a signal representing mode change;

(f-6) determining whether there is a jamming in said copy machine, and upon yes answering, stopping said sorter in order to wait until said jamming is removed;

(f-7) determining whether said bin tray is to be transferred;

(f-8) performing said bin up subroutine and a bin down subroutine, then returning to said (d) step.

6. A method for controlling a sorter as claimed in claim 2, wherein said step (g) comprises the steps of:

(g-1) determining whether said uppermost bin tray is located at said waiting position;

(g-2) upon no answering, determining whether said uppermost bin tray is located at said home position;

(g-3) If said uppermost bin tray is not located at said home position, performing said home subroutine, then said bin up subroutine;

(g-4) setting up said mode state into a group mode;

(g-5) sensing a signal representing whether a copy sheet is ejected and a signal representing mode change;

(g-6) determining whether there is a jamming in said copy machine, and upon yes answering, stopping said sorter in order to wait until said jamming is removed;

(g-7) receiving copy sheets of a document of a page to the last sheet, then performing said bin up subroutine according to a bin transferring demand, then returning to said (d) step.

7. A method for controlling a sorter as claimed in any one of claim 3 to 6, wherein said bin up subroutine comprises the steps of:

(i) checking a subject tray number to be transferred after starting a transferring of a bin tray upwards;

(j) stopping said upward transferring after allotting said bin tray with a predetermined delay time corresponding to said bin tray number;

(k) incrementing said bin tray number, then returning to said main routine.

8. A method for controlling a sorter as claimed in claim 7, wherein said delay time allotted to said bin trays is a predetermined delay time in case of non-sort mode, or so increasing delay time that a relatively lower bin tray may be allotted with a relatively longer delay time in case of the other modes.

* * * * *